US005851141A

United States Patent [19]

Elmore

[11] Patent Number: 5,851,141

[45] Date of Patent: Dec. 22, 1998

[54] ELONGATED ORBITAL POWER SANDER

[76] Inventor: Ronald W. Elmore, 1442 Wildwood Lakes Blvd. # C 103, Naples, Fla. 34104

[21] Appl. No.: 762,525

[22] Filed: Dec. 9, 1996

[51] Int. Cl.[6] ..... B24B 23/00; B24B 27/08

[52] U.S. Cl. ..... 451/357; 451/344; 451/356

[58] Field of Search ..... 451/357, 441, 451/356, 344; 30/393; 83/647; 173/216, 217

[56] References Cited

U.S. PATENT DOCUMENTS

| | | | |
|---|---|---|---|
| 2,307,431 | 1/1943 | Tilden et al. | 451/356 |
| 2,350,098 | 5/1944 | Decker | 451/356 |
| 2,526,976 | 10/1950 | Smith | 451/356 |
| 2,553,688 | 5/1951 | Thompson | 451/344 |
| 3,905,429 | 9/1975 | Berger | 173/216 |
| 4,550,501 | 11/1985 | Moores, Jr. et al. | 30/393 |
| 4,819,334 | 4/1989 | Mongeon | 30/393 |
| 5,022,189 | 6/1991 | Saul | 451/356 |
| 5,201,749 | 4/1993 | Sachse et al. | 30/393 |
| 5,209,022 | 5/1993 | McCambridge | 451/356 |
| 5,212,887 | 5/1993 | Farmerie | 30/393 |
| 5,360,073 | 11/1994 | Akazawa | 173/217 |
| 5,453,040 | 9/1995 | Schaal et al. | 451/357 |
| 5,458,533 | 10/1995 | Barth et al. | 451/357 |
| 5,653,294 | 8/1997 | Thurler | 173/217 |

*Primary Examiner*—David A. Scherbel
*Assistant Examiner*—Derris H. Banks

[57] ABSTRACT

This invention pertains to a power sander particularly useful in the trade of painting, specifically designed when painting louvered doors having parallel slats at an angle therein. When painting unpainted louvered doors, a primer must first be applied. To enhance the smoothness and attractiveness of the same, the primer must be sanded and up to this date it could only be done by hand because no appropriate tools where available. The tool of this invention solves the above noted problem. It is a hand held and light weight tool having an elongated blade extending from its forward end. The blade in its lateral extent is somewhat tapered but the thickness remains the same and it conforms to the space between adjacent slats. The mechanism inside the housing of the tool drives the blade in an orbital manner to simulate hand sanding. The blade has abrasive grit thereon and will sand the surfaces of two confronting slats at the same time.

14 Claims, 4 Drawing Sheets

ELONGATED ORBITAL POWER SANDER

BACKGROUND OF THE INVENTION

This invention pertains to the trade of painting, particularly the contract painting but not necessarily restricted thereto. It is particularly designed for the sanding of louvered doors. As is well known, louvered doors consist of a multiple of slats that are arranged parallel to each other but at an inclined angle. In so called plantation shutters, the angle of the louvers are adjustable relative to each other. The doors themselves come in many sizes and are installed in many different locations, such as on medicine cabinets, privacy shutters or bi-fold doors.

The doors are normally installed in their raw state, that is, without paint because at the point of installation the color scheme is never known in advance. The finishing or painting process involves a first application of a primer to form a proper foundation for the finishing paint coat. Between prime and finishing coats, the wood has to sanded to insure a smooth and attractive appearance.

The sanding process involves sanding each individual slat on both sides. In multi-dwellings such as condominiums, man-hour allocations for sanding louvered doors is extraordinary with very low productivity when compared to other surfaces. Additionally, worker frustration and boredom is an integral part of the process. Further, material costs for sandpaper and sanding blocks is excessive. There are no tools available that aid in the sanding process. Known sanding tools are vibrating flat surface sanders, belt sanders, or rotating circular disk sanders. However, these sanders are all flat surface sanders that will not allow the sanding surfaces to reach in between the parallel slats of louvered doors. Therefore, hand sanding was the only solution to this day.

OBJECTS OF THE INVENTION

It is therefore an object of this invention to develop a tool that is versatile, is light weight and has a sanding surface that will reach between the parallel slats and sand both surfaces of opposing slats at the same time with a minimal time and energy expenditure. Obviously, a blade having abrading surfaces thereon and of proper dimensions should be contemplated. The blade should be power driven and should have the correct motion to simulate the process of hand sanding. This tool will hereinafter be described in detail by making reference to the drawings.

DETAILED DESCRIPTION OF THE DRAWINGS

Figures 1, 2:
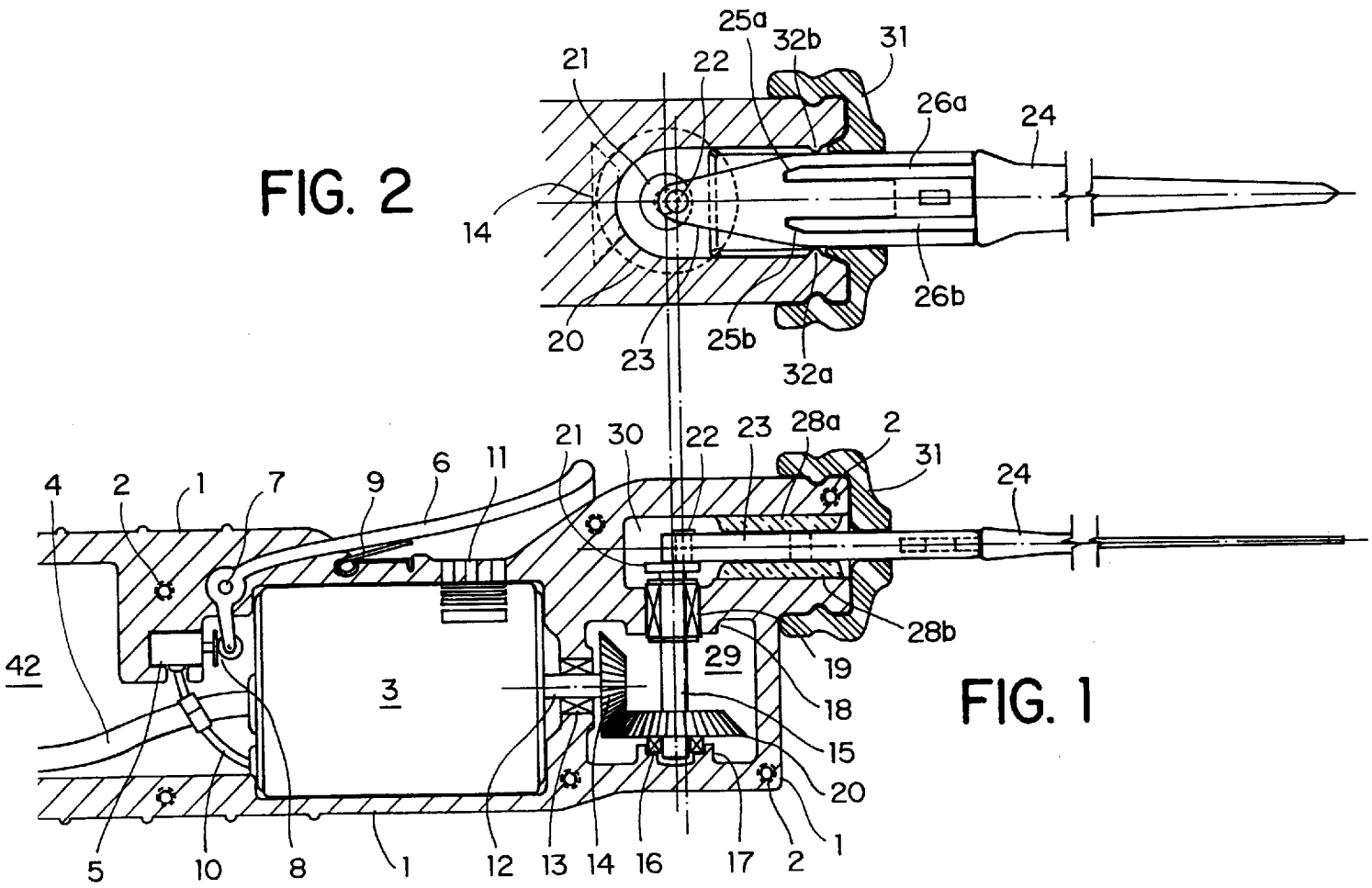
FIG. 1 is a cross section through a tool for driving a sanding blade.
FIG. 2 is a top view of a mechanism for driving the blade.

Referring now to FIG. 1, there is shown a housing 1 which is shown in cross section. The housing 1 could also consist of two halves for ease of installation of the various components that make up the power tool. When two halves are being used, they are secured to each other by connecting bolts (not shown) being passed through holes 2. A motor 3 is placed within the housing and is powered by the electric line 4. The electric line could come from a regular power source or from a portable and rechargeable battery. Switch 5 is actuated by a switch lever 6 on the outside of the housing which is fulcrumed around pin 7 which activates the roller and plate mechanism 8 of switch 5. The switch lever 6 is held in a neutral or off position by steel spring blade 9. Line 10 is an electric connection from the switch 5 to the motor 3. The openings 11 represent openings or louvers in the housing 1 for the purpose of cooling the motor 3.

The motor 3 has a motor shaft 12 extending in the direction of the housing 1 and is supported by the roller or needle bearing 13. The motor shaft also has affixed thereto a bevel gear 14. Another driven shaft 15 is mounted in the housing 1 and is supported at one end by a thrust bearing 16 which itself is supported by a housing gland 17. The other end of the driven shaft 15 is supported by a roller or needle bearing 19 which in turn is supported in the housing gland 18. The driven shaft 15 is driven by a bevel gear 20 which meshes with the bevel gear 14 which is driven by the motor 3.

With reference to FIG. 2, it has been mentioned earlier in the objects of the invention that a sanding blade should be driven to simulate the motions of hand sanding. Therefore, the sanding blade 24 should be driven in a circular or orbital motion. For this purpose, the driven shaft 15 has a circular disc 21 firmly attached at its end facing away from the bevel gear 20. A pin 22 is fastened to disc 21 in an eccentric manner or off center. This pin is attached to a support element 23 which is therefore. This movement imparts an orbital movement to the driven support element 23. In order to properly control the orbital movement of the support element 23, lateral bearing surfaces or glands 32*a* and 32*b* are mounted in the housing 1. With other words, the driven support element 23 is in sliding contact with these bearing surfaces or glands 32*a* and 32*b* but the sides of the support element 23 can fulcrum around the glands because, after all, the support element is not driven in linear direction. In order to support the driven element 23 in a direction transverse to the bearing surfaces 32*a* and 32*b* or 90° thereto, bearing plates 28*a* and 28*b* are installed in the housing 1 so that they are in a snug and sliding contact with the driven support element 23. The bearing plates 28*a* and 28*b* should be of a metal known for its bearing quality such as brass, for example.

The driven support element 23 should extend for some distance to the outside of the housing so that the sanding blade 24 can be fastened thereto as will be explained below. The end of the support element 23, which is remote from its driven end, has a dovetail configuration to thereby create channels 25*a* and 25*b*. One end of the sanding blade 24 has a forked configuration such as tines 26*a* and 26*b*. The details of these configurations will be described below with reference to FIG. 6. The housing 1 should be configured such as to create a closed chamber 29 where the bevel gears are located and a chamber 30 where the eccentric driving elements are located. The chambers should contain appropriate greases for permanent lubrication purposes. Finally, a rubber boot 31 should surround the mouth of the housing 1 and be in contact with the orbiting support element 23 to prevent any dust and/or dirt from entering the interior of the housing.

Figures 3, 4:
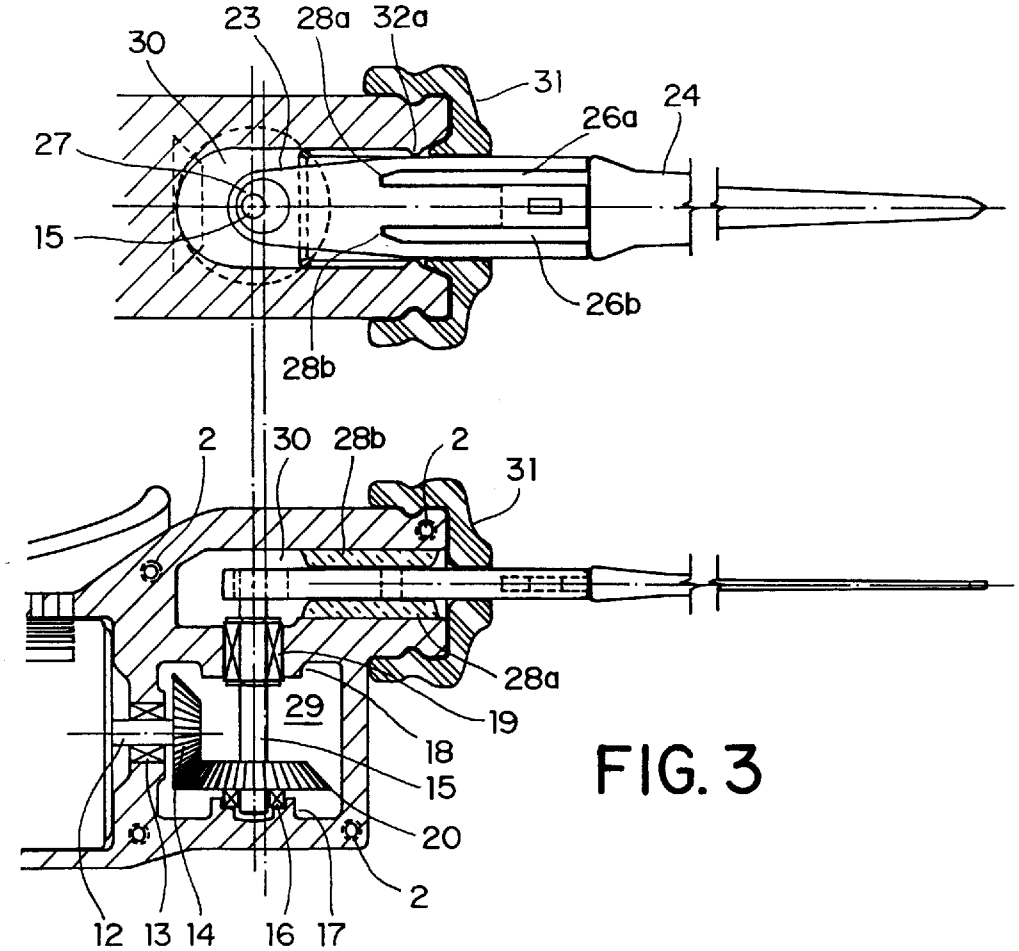
FIG. 3 is a cross section through a tool for driving a sanding blade but a different embodiment.
FIG. 4 is a top view of a different mechanism for driving the blade.

FIG. 3 shows only the right hand of the power tool described in FIG. 1 with the same reference characters applied to the same elements. The only difference from the embodiment explained in FIG. 1 is the mechanical drive for driving the driven support element 23. To this end, the end of the shaft 15 that is remote from the end having the bevel gear has a circular disc or cylinder fastened thereto but in an eccentric manner, that is, not coaxial with shaft 15. The top view shown in FIG. 4 shows the eccentricity. The driven support element 23 at one end has a bore that is the same size as that of the disc and completely surrounds the same when assembled. Therefore, it is clear that when shaft 15 is rotating, the eccentric disc or cylinder will impart a to- and fro- and a side-to side- movement to the support element 23. Thereby, the sanding blade 24 undergoes an orbital movement as is contemplated by the invention.

Figure 5:
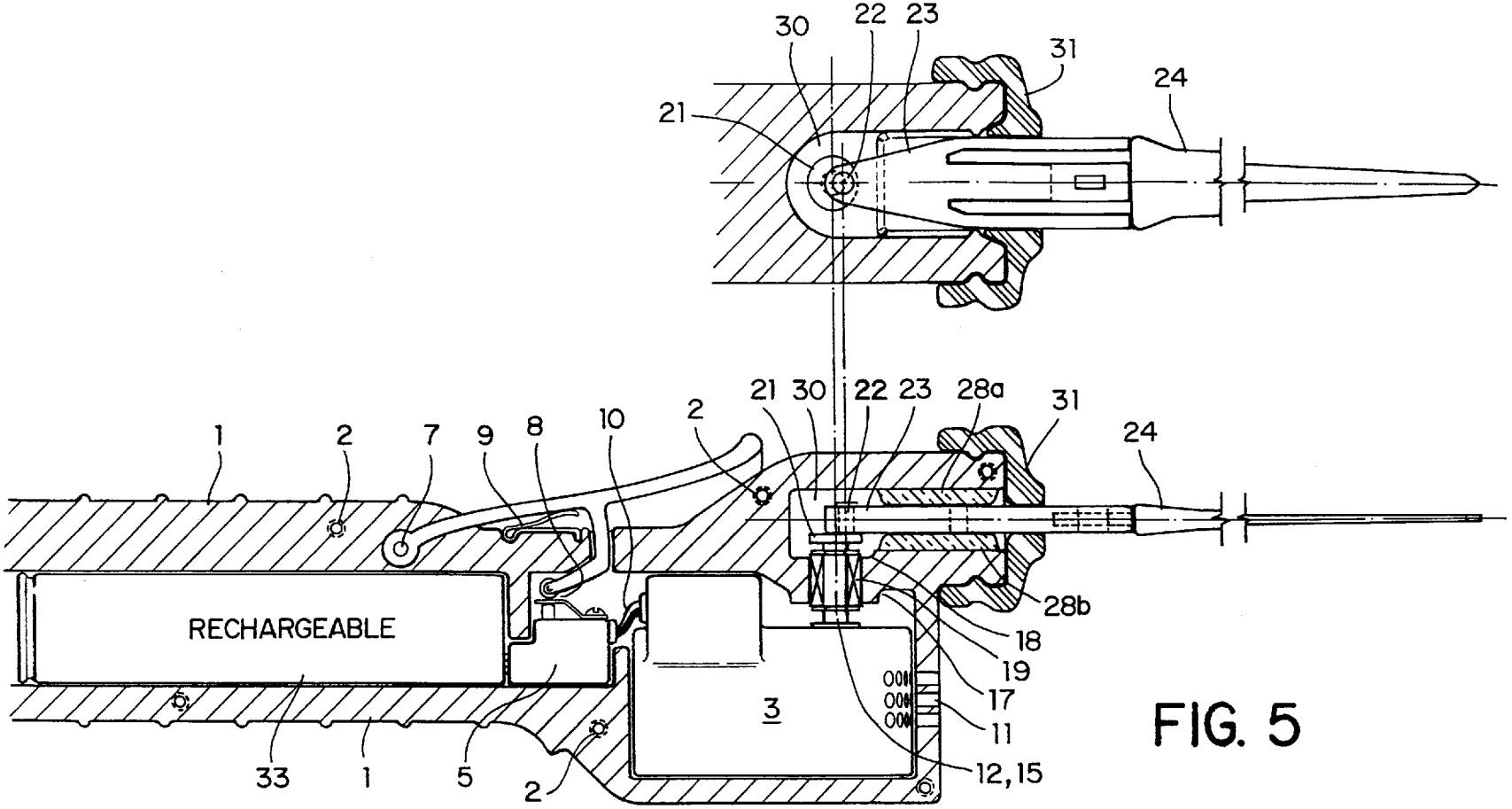
FIG. 5 is a cross section through a tool for driving a sanding blade but having a different motor drive.

FIG. 5 is similar to FIG. 1 in all respects and like reference characters have been applied to the same elements. The difference in this FIG. 5 is in that shaft 15 is driven directly by motor 3. Therefore, motor shaft 12 and driven shaft 15 are the same and are coaxial. The orbital drive for the support element 23 is the same as shown in FIG. 2.

It may be pointed out at this time that various considerations may be made as to whether to use bevel gears or a direct drive from motor 3. It is desirable to impart high vibratory motions to the sanding blade 24 to a point were the motions can not be seen but only felt. A direct drive high speed motor would accomplish this desire without hardly applying a slow-down load on the motor when, for example, an operator of the tool would bear down on the orbiting sander with more force than usual. Of course, a bevel gear driven shaft 14 as shown in FIGS. 1 and 3 can be used with the same desirable results. However, if any gearing could be eliminated, the result would be a reduction in noise and/or heat. It is also contemplated that a motor could be employed wherein the motor shaft is placed parallel to the driven shaft 15. Such a drive is well known in the art where saber saws are driven in a reciprocatory manner. In this case, spur gears instead of bevel gears would have to be used in order to impart a driving force to shaft 15. Everything else would be the same as far as the mechanism is concerned that imparts the orbital motion to the sanding blade.

Figure 6:
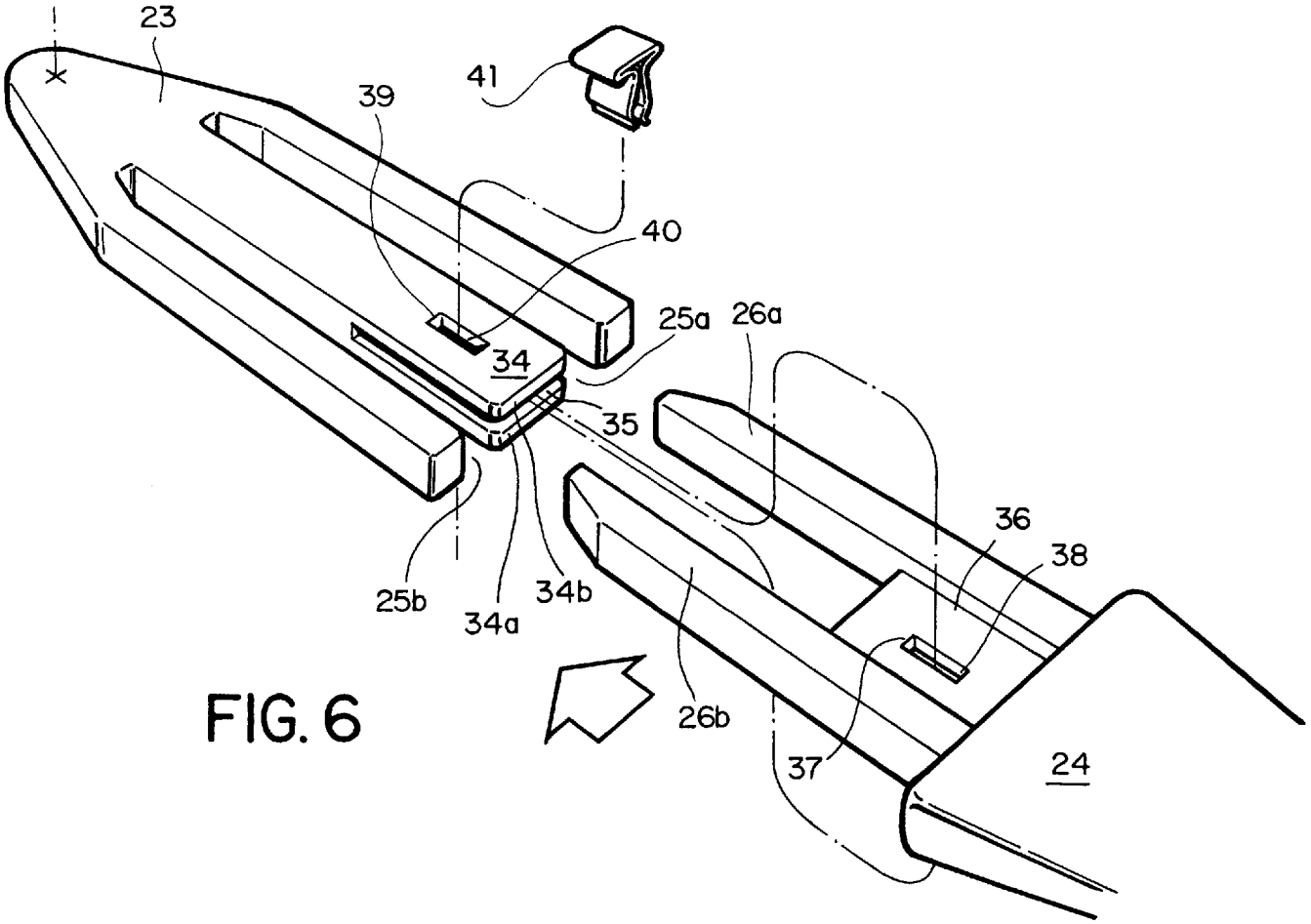
FIG. 6 is a perspective view of a connection of a sanding blade to a driving support element.

FIG. 6 shows the separable connection between the driven support element 23 and the sanding blade 24. With reference to FIGS. 2 and 4 it has been pointed out and explained above that support element 23 has a dovetail configuration creating channels 25*a* and 25*b* to leave a tongue piece 34 there between. The tongue piece 34 itself is split into two tongue pieces 34*a* and 34*b* to thereby create a space 35 there between. Between the two tines 26*a* and 26*b* of the sanding blade 24, a shelf 36 has been formed and has been reduced in thickness to conform exactly to space 35 that was created in the split tongue. This shelf 36 is provided with an elongated hole 37 having a camming edge 38. Likewise, the same dimensioned hole 39 is provided in both tongue pieces 34*a* and 34*b* and also having the camming edge 40. When the sanding blade 24 is pushed into the dove-tailed configuration of the driven support element 23, the tines 26*a* and 26*b* will slide into the channels 25*a* and 25*b* of support element 23 and at the same time the shelf 36 slides into the space 35 between the tongue pieces 34*a* and 34*b* to create a rigid and solid connection between the driven support element 23 and the sanding blade 24. It is important that this connection be maintained during all sanding operations and for this purpose a steel spring clip 41 is used. When spring clip 41 is pushed through holes 37 and 39, its legs are cammed past the camming edges 38 and 39 and thereafter are securely locked behind the same. A pushing instrument, such as a screw driver will only be able to dislodge the clip 41 from its locked position by applying a force from the other direction which is opposite from the direction of the insertion. This clip being inserted into the connection is outside of the housing which makes it extremely simple to change blades when so desired.

The blade 24 itself should be made of a rigid but somewhat flexible material such as hard rubber or TEFLON. By being somewhat flexible, the blade will easier conform to any surface irregularities of the material to be sanded. It also enhances the feel for the tool for the operator. It also prevents jamming of the blade in the space between adjacent slats.

As seen in FIGS. 1 to 4, the blade should have the same thickness in its elongated extent but should be somewhat tapered in its lateral or widthwise extent. The tapering will help in the sanding operation by being able to turn the tool and thereby the direction of the orbiting blade to enable the same to reach into corners where the louver slats meet the door frame.

The sanding material on the blade can be derived from many different sources. The sanding material could be embedded in an epoxy on the blade in the form of a grit. However, when the grit has worn down to thereby render the abrasive action ineffective, the entire blade has to be discarded. Another way to apply an abrasive material to the blade 24 is to wrap a self-adhesive sandpaper around the same. When worn down, it simply can be replaced with another sandpaper without having to remove the blade from the tool. On the other hand, as has been shown above, it is extremely simple to remove a blade 24 from the driven support element 23. Therefore, quite a few extra blades can be prepared ahead of time and when any of the abrasives are worn out, it is a simple task of replacing a blade without having to prepare a new one because a new one is already standing by.

Referring back to FIG. 5, there is shown the interior 42 of housing 1 having a rechargeable battery placed therein. This rechargeable battery could be placed in the interiors 42 of the tools shown in FIGS. 1 and 3 also.

What I claim is:

1. An elongated power sander having a hand held housing extending in a longitudinal direction and having a top and a bottom including an electric motor placed therein, a driven shaft mounted within said housing transverse to the longitudinal direction of the housing, said driven shaft having two ends means for driving said shaft at one of its ends by said motor in the bottom of said housing, a driven support element placed in the top of said housing and means for driving said support element in an orbital manner by the other of its ends of said driven shaft, said support element has an end that extends to the outside of said housing and means for separably attaching a sanding blade to said support element at said end that is outside of said housing, said sanding blade extends in the same linear direction as said support element.

2. The power sander of claim 1, wherein said means for driving said driven shaft comprises bevel gears affixed to said motor shaft and said driven shaft, respectively.

3. The power sander of claim 1, wherein said means for driving said driven shaft comprises said motor shaft driving said driven shaft in a direct coaxial relationship.

4. The power sander of claim 1, wherein said means for driving said support element in an orbital manner includes a circular disc affixed coaxially on said driven shaft at its end in the upper housing, said disc further having a driving pin affixed eccentrically on said disc, said pin being in rotational and driving contact with said support element.

5. The power sander of claim 1, wherein said means for driving said support element in an orbital manner includes a circular disc affixed eccentrically on said driven shaft at its end in the upper housing, said disc being received in a circular bore in said support element to drive the same in an orbital manner.

6. The power sander of claim 1, wherein the upper housing includes lateral bearing glands in contact with said orbiting support element to guide the same through its orbiting motion.

7. The power sander of claim 1, wherein the upper housing includes bearing plates placed above and below said support element to guide the same through its sliding motion.

8. The power sander of claim 1, wherein said means for separably attaching includes a dove tail configuration at the outer end of said support element including two channels formed thereby leaving a tongue there between, said sanding blade at one end having a fork having at least two tines and having a shelf between said tines, said tines being received in said channels when assembled.

9. The power sander of claim 8, wherein said tongue of said support element is split into two tongue pieces leaving a space there between, said shelf of said sanding blade being reduced to the thickness of the space between said tongue pieces, said shelf being received in said space when assembled.

10. The power sander of claim 9, including elongated holes being placed in each of said shelf and tongue pieces each having camming edges and a spring clip having depending legs being pushed into said elongated holes while the depending legs will cam themselves behind the camming edges to firmly lock said support element and said sanding blade together.

11. The power sander of claim 1, wherein the sanding blade is made of a rigid but somewhat flexible material.

12. The power sander of claim 1, wherein the sanding blade has an abrasive grit thereon affixed in an epoxy.

13. The power sander of claim 1, wherein said sanding blade has sand paper thereon held in place by a self-adhesive backing.

14. The power sander of claim 1, wherein said housing has a chargeable battery therein.

* * * * *